US007249977B2

(12) United States Patent
Schmieding et al.

(10) Patent No.: US 7,249,977 B2
(45) Date of Patent: Jul. 31, 2007

(54) USB TYPE PLUG CONNECTOR

(75) Inventors: Dirk Schmieding, Bad Essen (DE); Christa Wellmann, Rahden (DE)

(73) Assignee: Harting Electric GmbH & Co. KG (DE)

( * ) Notice: Subject to any disclaimer, the term of this patent is extended or adjusted under 35 U.S.C. 154(b) by 534 days.

(21) Appl. No.: 10/635,174

(22) Filed: Aug. 6, 2003

(65) Prior Publication Data

US 2004/0033725 A1 Feb. 19, 2004

(30) Foreign Application Priority Data

Aug. 16, 2002 (DE) ..... 202 12 590 U

(51) Int. Cl.
*H01R 33/97* (2006.01)

(52) U.S. Cl. ..... 439/654

(58) Field of Classification Search ..... 439/638, 439/607, 76.1, 654, 541.5
See application file for complete search history.

(56) References Cited

U.S. PATENT DOCUMENTS 4,392,701 A * 7/1983 Weidler ..... 439/638
4,799,901 A * 1/1989 Pirc ..... 439/620
5,513,075 A * 4/1996 Capper et al. ..... 439/713
5,676,569 A 10/1997 Davis ..... 439/731
5,961,350 A * 10/1999 Shiu ..... 439/607
6,027,375 A 2/2000 Wu ..... 439/607
6,120,321 A 9/2000 Wu ..... 439/541.5
6,183,292 B1 * 2/2001 Chen et al. ..... 439/541.5
6,238,241 B1 5/2001 Zhu et al. ..... 439/541.5
6,296,534 B1 * 10/2001 Yi ..... 439/638
6,307,756 B1 10/2001 Liu et al. ..... 361/816
6,343,957 B1 * 2/2002 Kuo et al. ..... 439/638
6,478,610 B1 * 11/2002 Zhou et al. ..... 439/541.5
6,504,726 B1 * 1/2003 Grabinger et al. ..... 439/638
6,729,897 B2 * 5/2004 Lai ..... 439/352

FOREIGN PATENT DOCUMENTS

EP 0 739 062 A1 10/1996
EP 0 928 049 A2 7/1999
EP 0 944 129 A1 9/1999

* cited by examiner

*Primary Examiner*—Briggitte R. Hammond
(74) *Attorney, Agent, or Firm*—Hayes Soloway P.C.

(57) ABSTRACT

A plug connector comprises a housing including an accommodation chamber, and a support plate which is arranged in the accommodation chamber and divides the latter in first and second sections. A first type of contact is arranged in the first section and a second type of contact is arranged in the second section. The second type of contact is a USB coupling.

10 Claims, 3 Drawing Sheets

USB TYPE PLUG CONNECTOR

TECHNICAL FIELD

The invention relates to a plug connector which has a first type of contact and a second type of contact.

BACKGROUND OF THE INVENTION

There are already known various plug connectors in which various types of contact are provided. Hence, there can be inserted various complementary plug connectors which have differing tasks, for instance transmitting an electrical supply power or transmitting data signals.

It is the object of the invention to provide a plug connector which makes it possible to directly poll data from an electrical device, for instance from automation devices such as a control cubicle.

BRIEF SUMMARY OF THE INVENTION

According to the invention, a plug connector comprises a housing including an accommodation chamber, and a support plate which is arranged in the accommodation chamber and divides the latter in first and second sections. A first type of contact is arranged in the first section and a second type of contact is arranged in the second section. The second type of contact is a USB coupling. It is possible to directly connect a PC or a monitor to the USB coupling, in order to e.g. read out the condition of the automation device or malfunction data.

According to the preferred embodiment of the invention provision is made that two USB couplings are provided which are mounted to the support plate so as to face away from each other. The USB couplings are surrounded by one shield each, a spring element being provided which connects the shields with each other. Such spring element is preferably used to connect the shields of the USB coupling with the housing, which likewise is made of the electrically conductive and, hence, shielding material.

According to the preferred embodiment of the invention the two USB couplings are surrounded by an insulating body which is provided with a cut-out, the spring element projecting through the cut-out and resting against the housing. In this arrangement, the spring element is preferably provided with a raised middle section projecting through the cut-out towards outside. For reliably making contact with the housing there may be made provision that the middle section has several contact-tabs which are bent off at an angle such that they touch the housing with a sharp edge.

According to the preferred embodiment of the invention provision is made that the support plate is freely placed in the accommodation chamber and indirectly secured by means of a fixing screw which right through the housing engages into the first type of contact mounted to the support plate. This makes it possible to secure the entire subassembly, comprised of the two USB couplings, the support plate and the first type of contact, in the housing by means of one single screw, so that there will be a low mounting expenditure.

It is preferably provided for that the support plate is a circuit board. This allows to electrically connect the two USB couplings without external cables. It is preferably provided for that the housing has a mounting flange. This allows the plug connector to be fixedly connected at low expenditure on the wall of a control cubicle, for example, so that there the PC can be connected, if the need arises, by means of which the desired data can be read out.

DETAILED DESCRIPTION OF THE PREFERRED EMBODIMENT

Figure 1:
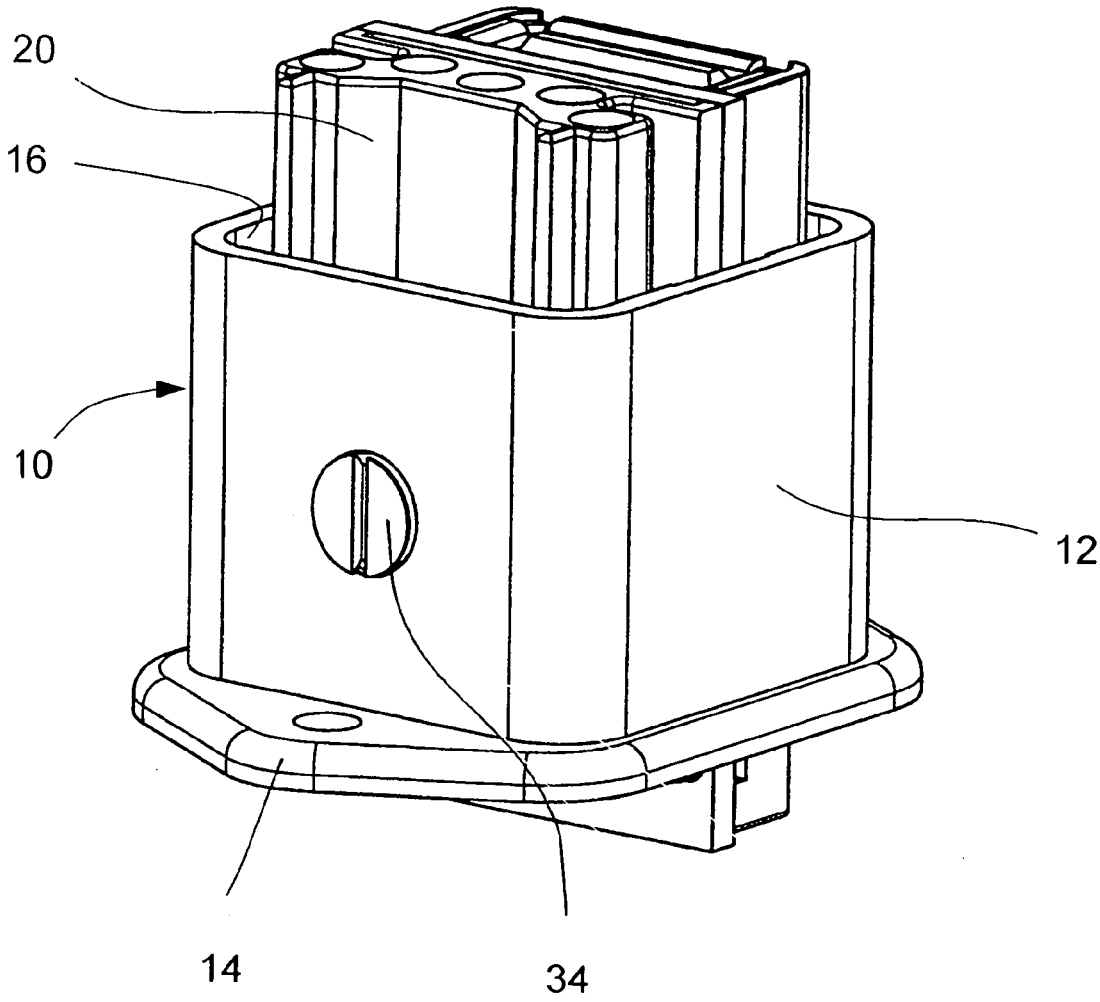
FIG. 1 shows in a perspective view a plug connector according to the invention.

In FIG. 1 there is shown a plug connector 10 which has a housing 12 that is made of an electrically conductive material, in particular metal. The housing 12 is provided with amounting flange 14 by means of which the plug connector can be mounted to a control cubicle, for instance.

Figure 2:
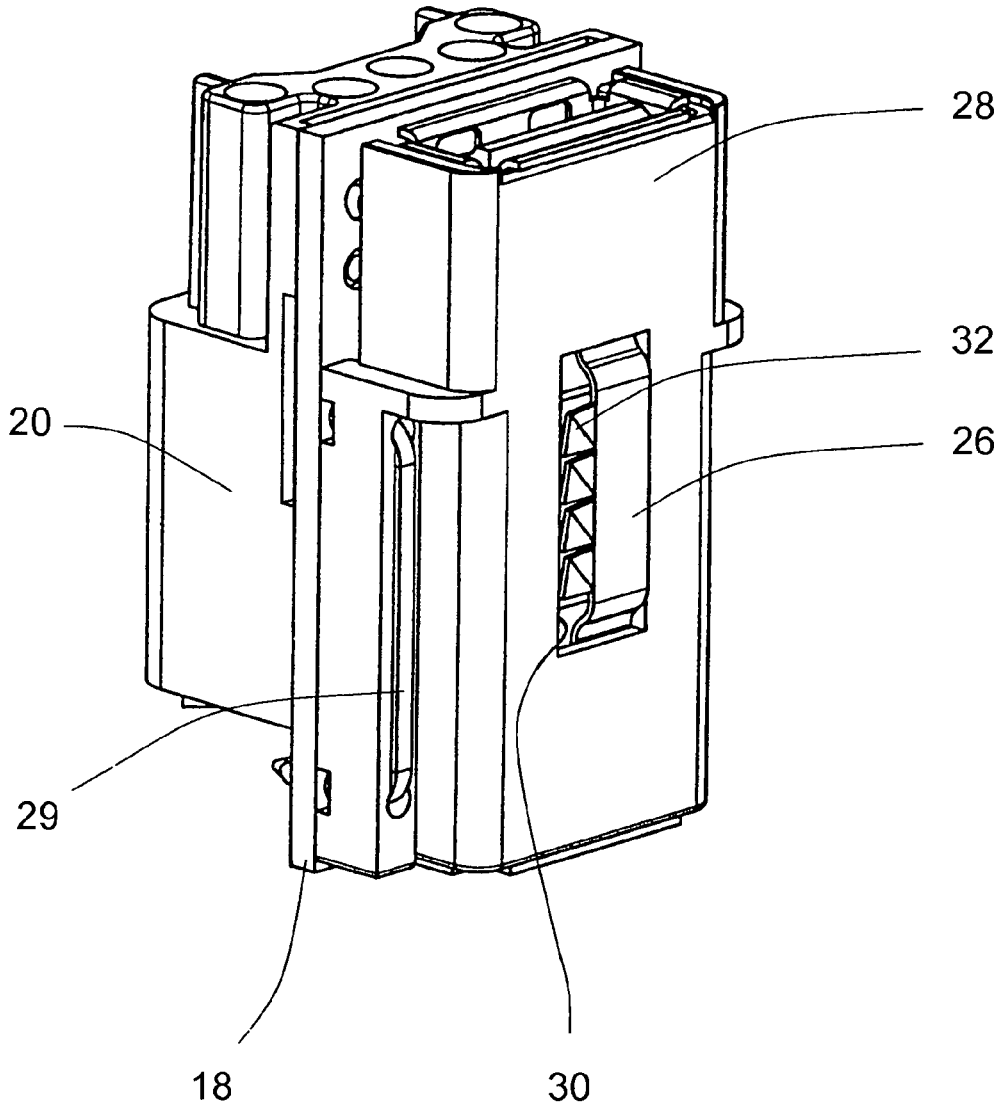
FIG. 2 shows an assembly unit inserted in the housing of the plug connector of FIG. 1, and comprised of the support plate, the contact insert and two USB couplings including insulating body.
Figure 3:
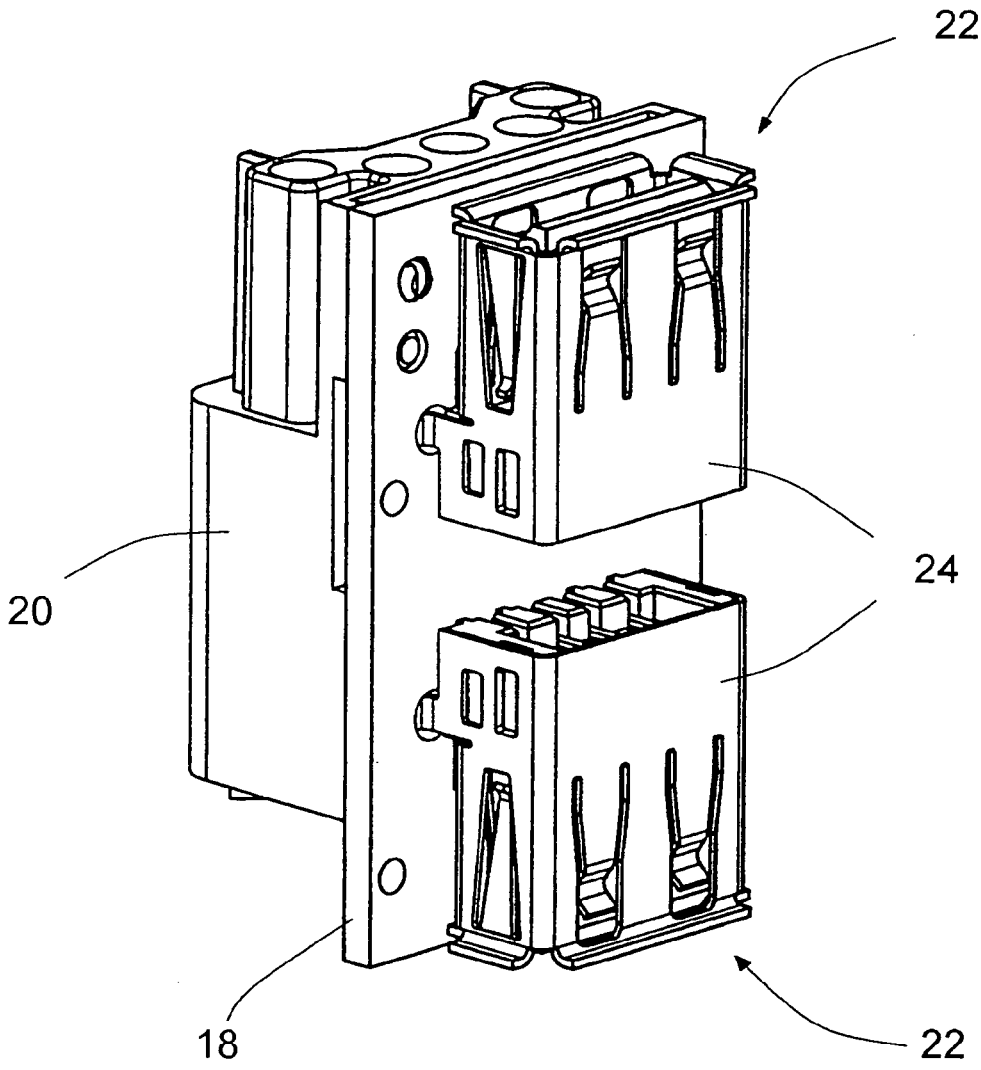
FIG. 3 shows the assembly unit of FIG. 2 with the insulating body omitted.

Formed in the interior of the housing 12 is an accommodation chamber 16 into which an assembly unit shown in FIG. 2 can be installed. This assembly unit consists of a support plate 18 which in this case is realized as a circuit board. Arranged on one side of the support plate 18 is a first type of contact, which is embodied as a socket insert 20 here. Arranged on the opposite side of the support plate 18 is a second type of contact which is formed here by two USB couplings 22. The two USB couplings are arranged on the support plate 18 so as to point in opposite directions, and they are connected with each other by (not shown) conductor tracks in the support plate.

Each USB coupling 22 has a shield 24 which is formed by a sheet metal housing. The two shields 24 of the USB couplings are electrically conductively connected with each other by a spring element 26 (see FIG. 2). The spring element 26 has a middle section raised towards outside with respect to the plane of the spring element, this middle section being provided with four contact tabs 32.

The spring element 26 is pressed against the shields 24 of the USB couplings by an insulating body 28 made of plastics. The insulating body 28 is fastened to the support plate 18 through two solder-in clips 29 and has a cut-out 30 through which extends the middle section of the spring element 26 including the contact tabs 32.

During assembly of the plug connector, the preassembled assembly unit shown in FIG. 2 is inserted into the accommodation chamber 16 of housing 12. In so doing, the contact tabs 32 rest against the housing by means of the edge bent off towards outside, so that a reliable contact with the shields of the USB couplings will be produced. Then a fixing screw 34 is screwed right through the housing into a threaded hole in the socket insert 20. In this way the socket insert 20, the support plate 18 with the socket insert 20 fastened thereon, as well as the USB couplings 22 which for their part are mounted to the support plate 18, will be anchored firmly in the accommodation chamber 16 of the housing 12.

As the support plate 18 is used for dividing the accommodation chamber 16 in first and second sections, there will be obtained a particularly clearly laid out structure of the plug connector according to the invention, resulting in advantages during equipping the support plate with the USB couplings and the socket insert, as well as in a particularly simple placement of the resultant assembly unit in the housing 12.

The invention claimed is:

1. A plug connector comprising a housing including an accommodation chamber, and a support plate which is arranged in said accommodation chamber and divides the latter in first and second sections, a first type of contact being arranged in said first section and a second type of contact being arranged in said second section, said second type of contact being a USB coupling, wherein two USB couplings are provided which are mounted to said support plate so as to face away from each other.

2. The plug connector according to claim 1, wherein said first type of contact is a socket insert.

3. The plug connector according to claim 1, wherein said housing has a mounting flange.

4. The plug connector according to claim 1, wherein said USB couplings are surrounded by one shield each, a spring element being provided which connects said shields with each other.

5. The plug connector according to claim 4, wherein said two USB couplings are surrounded by an insulating body which is fastened to said support plate by two solder-in clips.

6. The plug connector according to claim 5, wherein said insulating body is provided with a cut-out, said spring element projecting through said cut-out and resting against said housing.

7. The plug connector according to claim 6, wherein said spring element is provided with a raised middle section projecting through said cut-out towards outside.

8. The plug connector according to claim 7, wherein said middle section is provided with several contact tabs which are bent off at an angle such that they touch said housing with a sharp edge.

9. A plug connector comprising a housing including an accommodation chamber, and a support plate which is arranged in said accommodation chamber and divides the latter in first and second sections, a first type of contact being arranged in said first section and a second type of contact being arranged in said second section, said second type of contact being a USB coupling, wherein said support plate is freely placed in said accommodation chamber and indirectly secured by a fixing screw which extends through said housing into engagement with said first type of contact mounted to said support plate.

10. A plug connector comprising a housing including an accommodation chamber, and a support plate which is arranged in said accommodation chamber and divides the latter in first and second sections, a first type of contact being arranged in said first section and a second type of contact being arranged in said second section, said second type of contact being a USB coupling, wherein said support plate is a circuit board.

* * * * *